US005524578A

United States Patent [19]

Craft et al.

[11] Patent Number: 5,524,578

[45] Date of Patent: Jun. 11, 1996

[54] TWO-CYCLE ENGINE HAVING IMPROVED IDLE RELIEF

[75] Inventors: Todd Craft, Pleasant Prairie; Tim Bowhall, Kenosha, both of Wis.; Dave Mate, McHenry, Ill.

[73] Assignee: Outboard Marine Corporation, Waukegan, Ill.

[21] Appl. No.: 536,721

[22] Filed: Sep. 29, 1995

[51] Int. Cl.[6] ..... F02B 77/08

[52] U.S. Cl. ..... 123/65 P; 123/735 P

[58] Field of Search ..... 123/65 R, 73 SP, 123/65 P

[56] References Cited

U.S. PATENT DOCUMENTS 4,668,199 5/1987 Freund et al. ..... 60/272
5,211,140 5/1993 Hironaka et al. ..... 123/65 P

FOREIGN PATENT DOCUMENTS 2509792 1/1983 France ..... 123/65 P

*Primary Examiner*—David A. Okonsky
*Attorney, Agent, or Firm*—Jack D. Nimz; R. Warren Comstock

[57] ABSTRACT

An engine having an engine block defining at least two cylinders having respective cylinder heads. Pistons are reciprocal within respective ones of the cylinders. The cylinders have respective fuel inlet ports and exhaust ports and two of said cylinders have an idle relief port disposed between their respective exhaust port and head ends. The idle relief ports of the cylinders are interconnected by a passageway for providing communication between the idle relief ports of said at least two cylinders. This has been found to provide reduced pull start resistance, reduced engine vibration during idle, and significantly reduced horsepower loss over a wide operating range which horsepower loss is normally associated with idle prior art relief structures which vent directly from idle relief ports to atmosphere.

14 Claims, 8 Drawing Sheets

TWO-CYCLE ENGINE HAVING IMPROVED IDLE RELIEF

FIELD OF THE INVENTION

The present invention pertains to two-stroke internal combustion engines, and more particularly pertains to an improved idle relief for two-stroke internal combustion engines.

BACKGROUND OF THE INVENTION

There are several shortcomings realized during starting and idle or low speed running of two-cycle engines. Among these shortcomings is a significant force required to move the pistons through the compression phase of their cycle during starting. This requires an unduly large pull force on the rope of a rope-start two-cycle engine. It is desirable to reduce the pulling effort required to start two-cycle engines. Also, after a two-cycle engine has been started, it suffers the shortcoming of producing significant engine shake and significant exhaust noise at idle speeds.

It is known to reduce the magnitude of each of the aforementioned shortcomings by providing an idle relief aperture in one or more of the cylinder walls of the engine at a height significantly above the cylinder's respective exhaust port which leads into a passage which communicates with the exhaust runner. The aperture and passage thereby provide a path for high pressure exhaust blow-down gas to flow from a point in the cylinder significantly above the exhaust port window to a point in the exhaust runner leading to atmosphere. While this has been found to be effective in reducing the requisite starting effort and reducing engine shake and exhaust noise level at low speeds, the provision of the idle relief aperture leading to the exhaust runners results in a significant horsepower loss throughout the normal operating range of the engine. There is a need for an engine having an improved idle relief structure which provides reduction of starting effort, reduced engine shake and reduced exhaust noise level for an engine operating at idle or low speed, which reduces the degree of horsepower loss of the engine.

SUMMARY OF THE INVENTION

In accordance with the present invention, it was found that by interconnecting the idle relief passages of two cylinders having respective pistons which reciprocate out of phase with one another, rather than extending the idle relief passages to the exhaust runners of the engine or otherwise providing communication between the idle relief aperture of the engine and atmosphere, the benefits of idle relief are realized without the significant horsepower loss realized by conventional idle relief. The interconnecting of the idle relief passageways eliminates the discharge of fresh charge through the idle relief aperture to atmosphere, which is a significant source of horsepower loss associated with conventional idle relief. With the improved idle relief construction taught by the present invention, any fresh charge which passes out of one cylinder through its respective idle relief hole is received in through the idle relief hole of another cylinder in the engine, so that the fresh charge is not released to atmosphere, but rather is retained within the engine whereby the fresh fuel charge is ultimately burned rather than being discharged as raw fuel to atmosphere.

DETAILED DESCRIPTION OF THE PREFERRED EMBODIMENTS(S)

Figure 1:
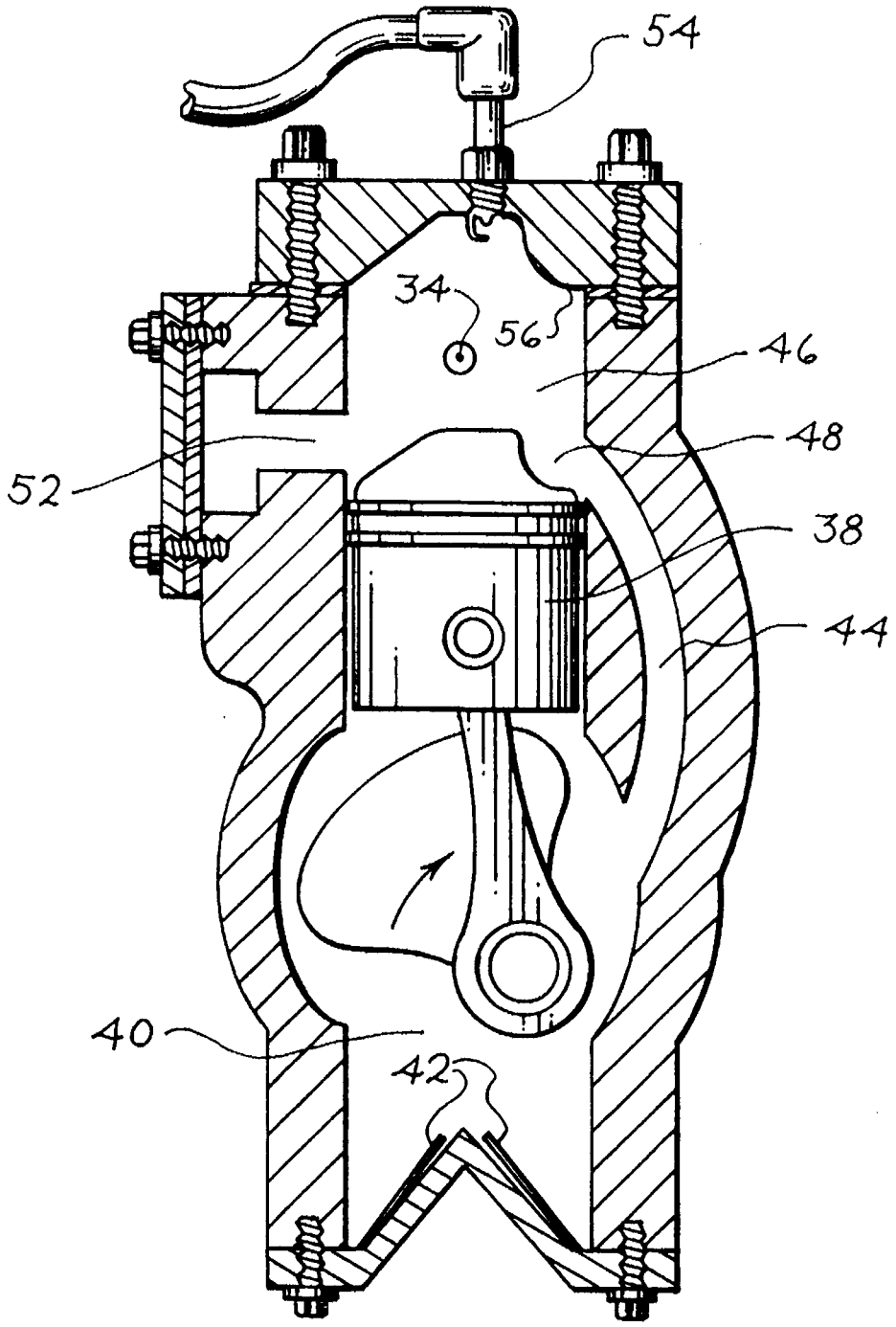
FIG. 1 is a side elevational view, in partial section, of a cylinder of an engine embodying various features of the present invention.
Figure 3:
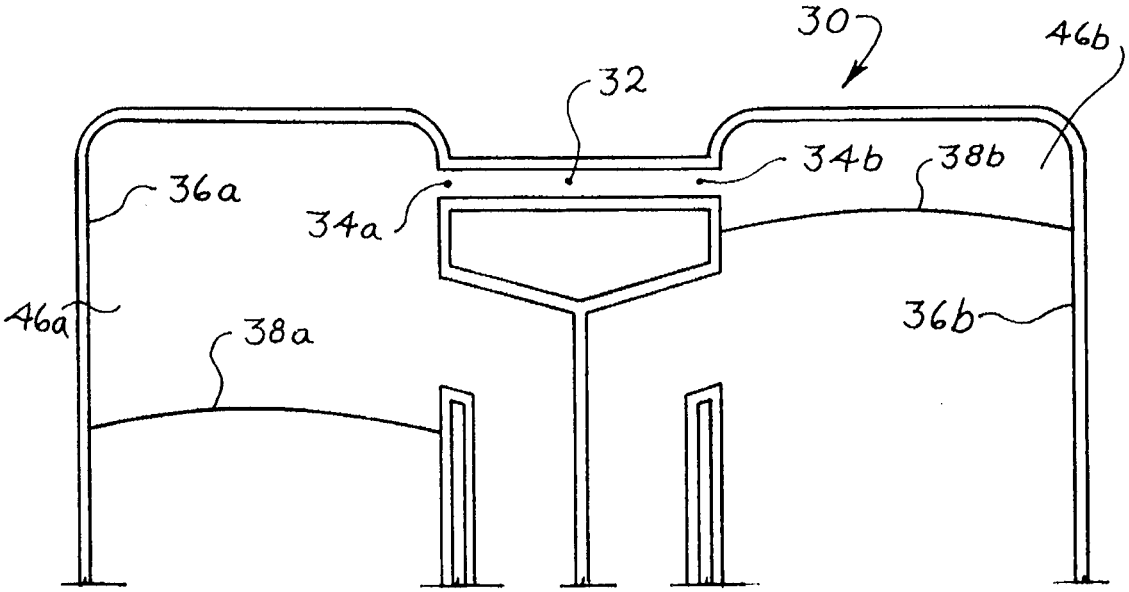
FIG. 3 is a schematic view of an embodiment of an idle relief arrangement embodying various features of the present invention, in which an idle relief passageway provides direct communication between the idle relief ports of two cylinders.

An engine embodying various features of the present invention is illustrated in FIGS. 1 and 3 and referred to generally by reference numeral 30.

Figure 2:
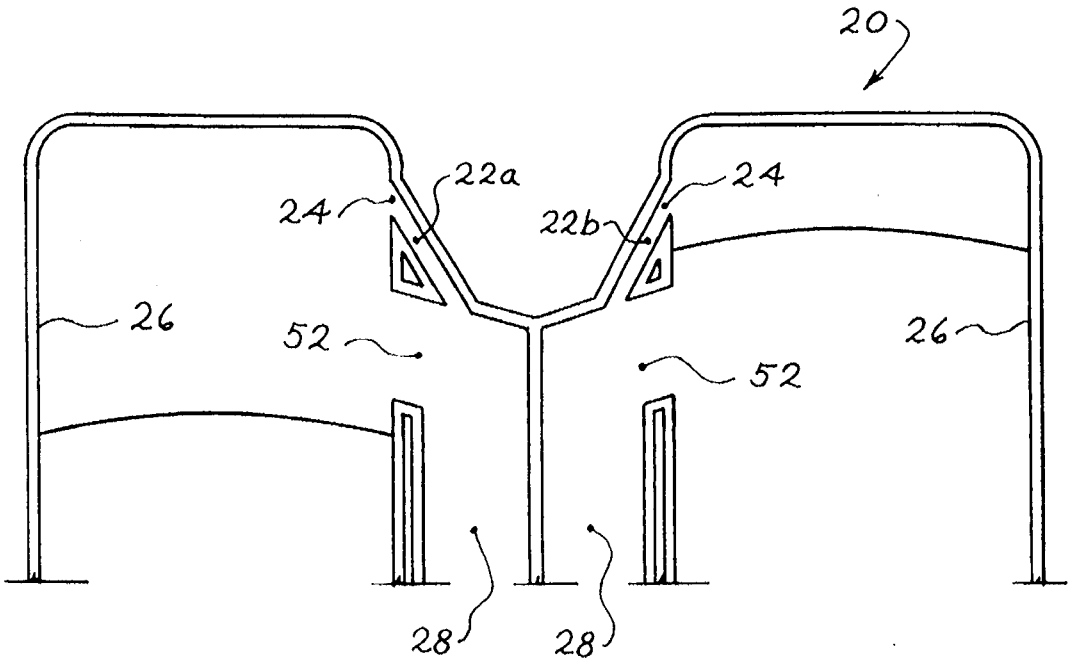
Fig. 2 (PRIOR ART)
FIG. 2 is a schematic view of a prior art idle relief arrangement, in which idle relief passageways provide direct communication between the idle relief ports and exhaust runners.

The invention may be easily understood in relation to prior art idle relief arrangements in two-cycle engines. A prior art two-cycle engine having an idle relief arrangement is illustrated schematically in FIG. 2 and referred to generally by reference numeral 20. As illustrated in FIG. 2, in prior art engines having idle relief structures, idle relief passages 22*a* and 22*b* are provided which extend from the idle relief ports 24 of each cylinder 26 to exhaust runners 28 which vent directly to atmosphere. Accordingly, with the prior art idle relief structure of FIG. 2, during the initial portion of the compression cycle of a two-cycle engine, during which period a fresh fuel charge is compressed in the cylinder from the time in which the piston moves from bottom-dead-center to the time the piston covers the idle relief port 24 in the cylinder 26, at least a portion of the fresh fuel charge is allowed to pass out of the cylinder to atmosphere through its respective idle relief port. This results in a power loss across virtually the entire operating range of the engine, attributable to the fuel being discharged to atmosphere without being burned in the engine.

In order to overcome the aforementioned problem of power loss associated with prior art idle relief arrangements in engines, in the preferred embodiment of the invention, as illustrated schematically in FIG. 3, an idle relief passageway 32 directly interconnects and provides direct communication between the idle relief ports 34*a* and 34*b* of two or more cylinders 36*a* and 36*b* of a two-cycle engine 30, such that the idle relief ports 34*a* and 34*b* do not communicate directly with atmosphere. That is, the idle relief ports 34*a* and 34*b* of two cylinders 36*a* and 36*b* having respective pistons 38*a* and 38*b* which reciprocate out of phase with one another (preferably 180 degrees out of phase with one another, although other arrangements may be employed) are preferably interconnected via a passageway 32 so that material expelled from a first cylinder 36*a* through its idle relief port 34*a*, passes through the passageway 32, and is received into a second cylinder 36*b* through its respective idle relief port 34*b*.

With reference to FIG. 1, as is well known in two-cycle engine technology, upward movement of a piston 38 in its cylinder 36 draws a fresh fuel charge into the crankcase 40 through reed valves 42, and subsequent downward movement of the piston 38 displaces the fresh fuel charge from the crankcase 40 through the transfer passage 44 and into the combustion chamber 46 (i.e., to a position above the piston 38) through the cylinder's transfer port 48. Subsequent upward movement of the piston 38 past the point at which the upper end 50 of the piston has been moved upwardly to a position above the transfer port 48 and exhaust port 52, whereby the piston 38 blocks the transfer and exhaust ports 48 and 52, results in compression of the fresh fuel charge in the combustion chamber 46. Thereafter, the spark plug 54 is energized to effect ignition and combustion of the compressed fuel charge in the combustion chamber 46, with the resultant thermal expansion in the combustion chamber forcing the piston 38 back downwardly in its cylinder 36 to a position below the exhaust port 52, whereby the products of combustion are allowed to pass through the exhaust port 52 and are discharged to atmosphere.

In the engine of the present invention, the idle relief ports 34*a* and 34*b* associated with the cylinders 36*a* and 36*b* are located above both their respective exhaust ports 52*a* and 52*b* and transfer ports 48*a* and 48*b*, i.e. the idle relief ports 34*a* and 34*b* are located closer to their respective cylinder heads 56*a* and 56*b* than the respective exhaust ports 52*a* and 52*b* and transfer ports 48*a* and 48*b*. Hence, once the upper end 50 of a piston 38 has been moved upwardly to a position above its respective exhaust port 52 and transfer port 48 so as to block the transfer and exhaust ports 48 and 52, the fresh fuel charge above the piston 38 is compressed and a portion of the compressed fuel charge is forced out of the first cylinder 36*a* through its idle relief port 32*a*. That is, during the period from the commencement of compression of the fresh fuel charge until the piston 38 has moved upwardly in its cylinder 36 into occluding relation with its idle relief port 32, a portion of the fresh fuel charge is allowed to pass or "bleed" out of the cylinder 36 through its idle relief port 32. Importantly, as will be discussed in detail further below, during the portion of the piston's cycle over which the piston 38 blocks off its idle relief port 34, flow through the idle relief port 32 is interrupted.

In the preferred embodiment of the invention, the pistons 38*a* and 38*b* of the two cylinders 36*a* and 36*b* reciprocate 180° out of phase relative to one another. Therefore, during the interval in which the first piston 38*a* is moving upwardly and compressing the fresh fuel charge but has not yet covered its respective idle relief port 34*a*, the second piston 38*b* is moving downwardly so as to draw a vacuum in its combustion chamber 46*b*. The pressure differential between the combustion chambers 46*a* and 46*b* of the two cylinders 36*a* and 36*b* facilitates the displacement of the fresh fuel charge out through the idle relief port 34*a* of the first cylinder 36*a* and into the idle relief port 34*b* of the second cylinder 36*b*, via the idle relief passageway 32 which provides communication between the idle relief ports 34*a* and 34*b*.

During the last half of the engine cycle, in which the first piston 38*a* is moving downwardly and the second piston 38*b* is moving upwardly, the same displacement occurs except in reverse, with a portion of the fresh fuel charge being displaced from the second cylinder's combustion chamber 46*b* through its idle relief port 34*b*, through the idle relief passageway 32 and into the idle relief port 34*a* of the first cylinder 36*a*. Each time a fresh fuel charge is displaced from a cylinder 36 through its idle relief port 34, a trailing portion of the displaced fuel remains in the idle relief passageway 32 intermediate the two idle relief ports 34*a* and 34*b*. More specifically, each time a quantity of fuel is discharged from, say, the first cylinder 36*a* through its idle relief port 34*a*, a trailing end portion the discharged quantity of fuel remains in the idle relief passageway 32 and does not reach the combustion chamber 46*b* of the second cylinder 36*b*.

Good idle relief results were obtained with an engine constructed in accordance with the following illustrative example. It should be noted that this example is only one of a wide variety of structures which may be produced in accordance with the present invention, and this example is in no way intended to be limiting or imply any limitations. With reference to FIG. 3, a 30 horsepower engine was employed comprising an engine block having two adjacent cylinders 36*a* and 36*b* with respective pistons 38*a* and 38*b* which reciprocate approximately 180° out of phase relative to one another. Both of the cylinders have respective idle relief ports 34*a* and 34*b* which communicate with one another through an idle relief passageway 32, with the idle relief ports 34*a* and 34*b* each having a diameter of between approximately 0.1875 inch and 0.250 inch, and located in the cylinders at a position corresponding to a crank angle position of between approximately 50 degrees and 57 degrees after top dead center. The exhaust ports of this illustrative engine are located at a position corresponding to a crank angle position of approximately 96 degrees after top dead center.

Figure 7:
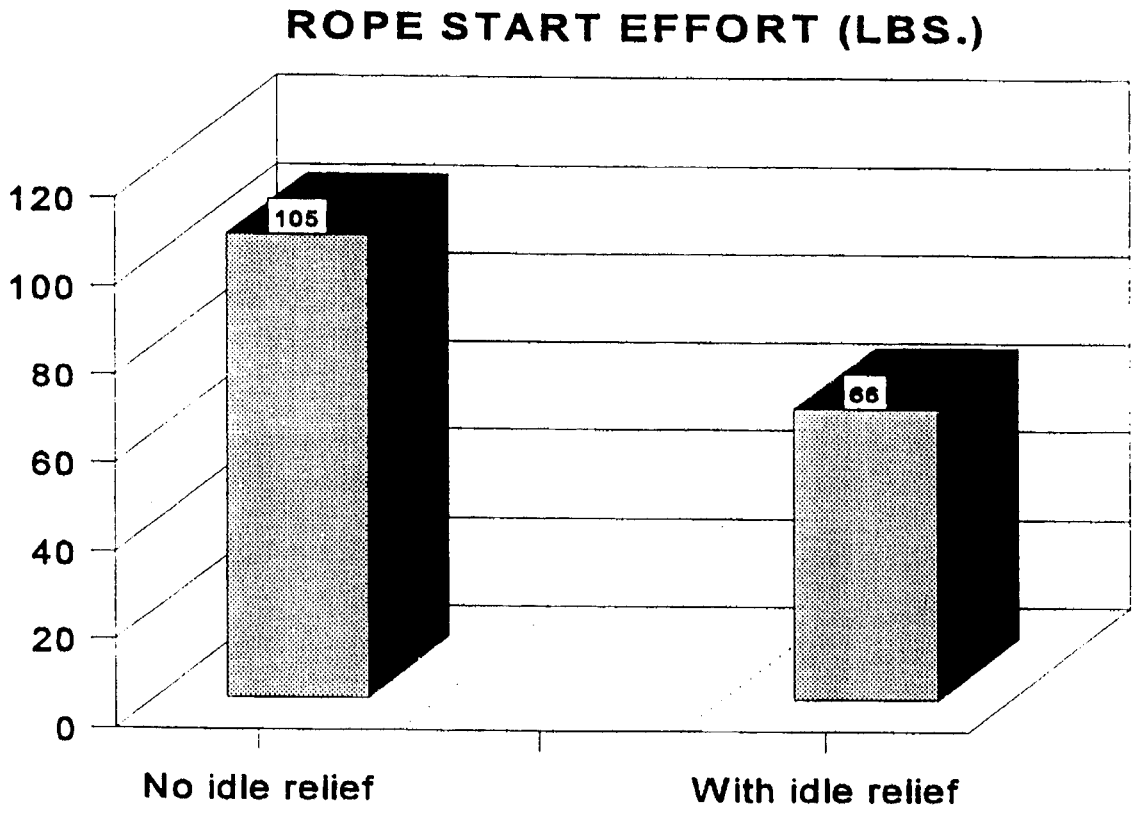
FIG. 7 is a graph illustrating the reduced rope start effort realized with the idle relief arrangement of the present invention.
Figure 8:
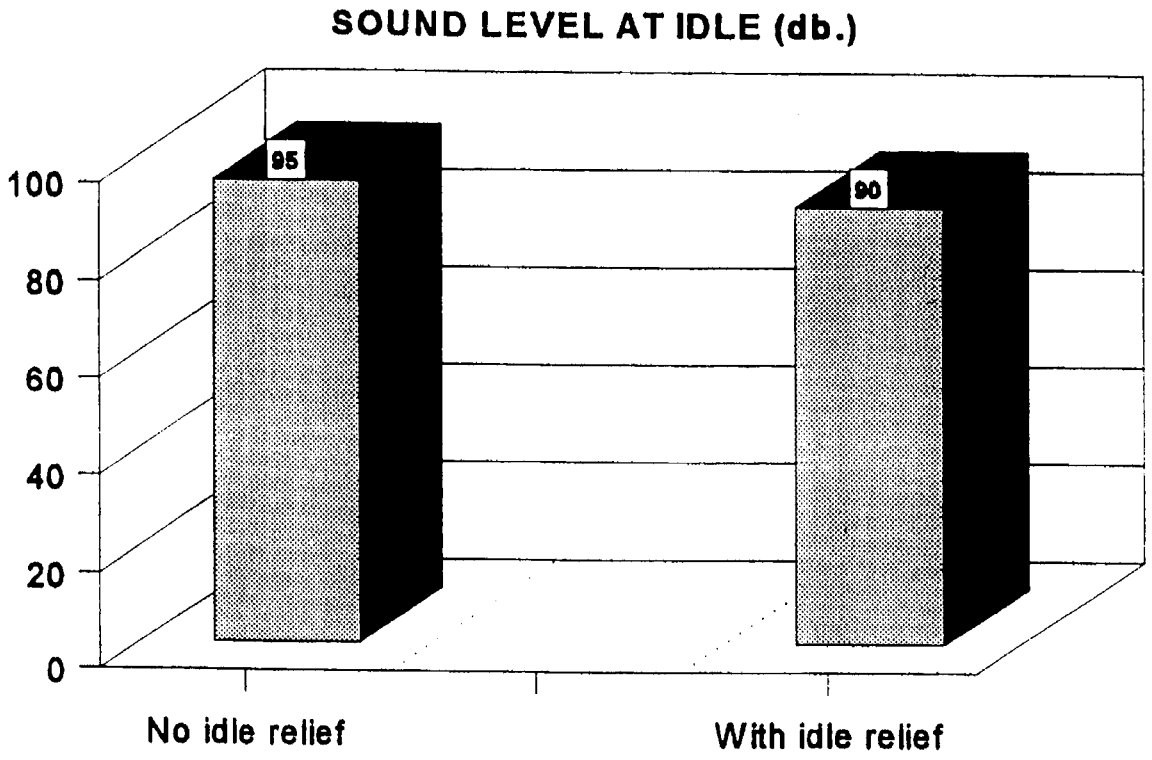
FIG. 8 is a graph illustrating the reduction in the sound level realized with the idle relief arrangement of the present invention.
Figure 9:
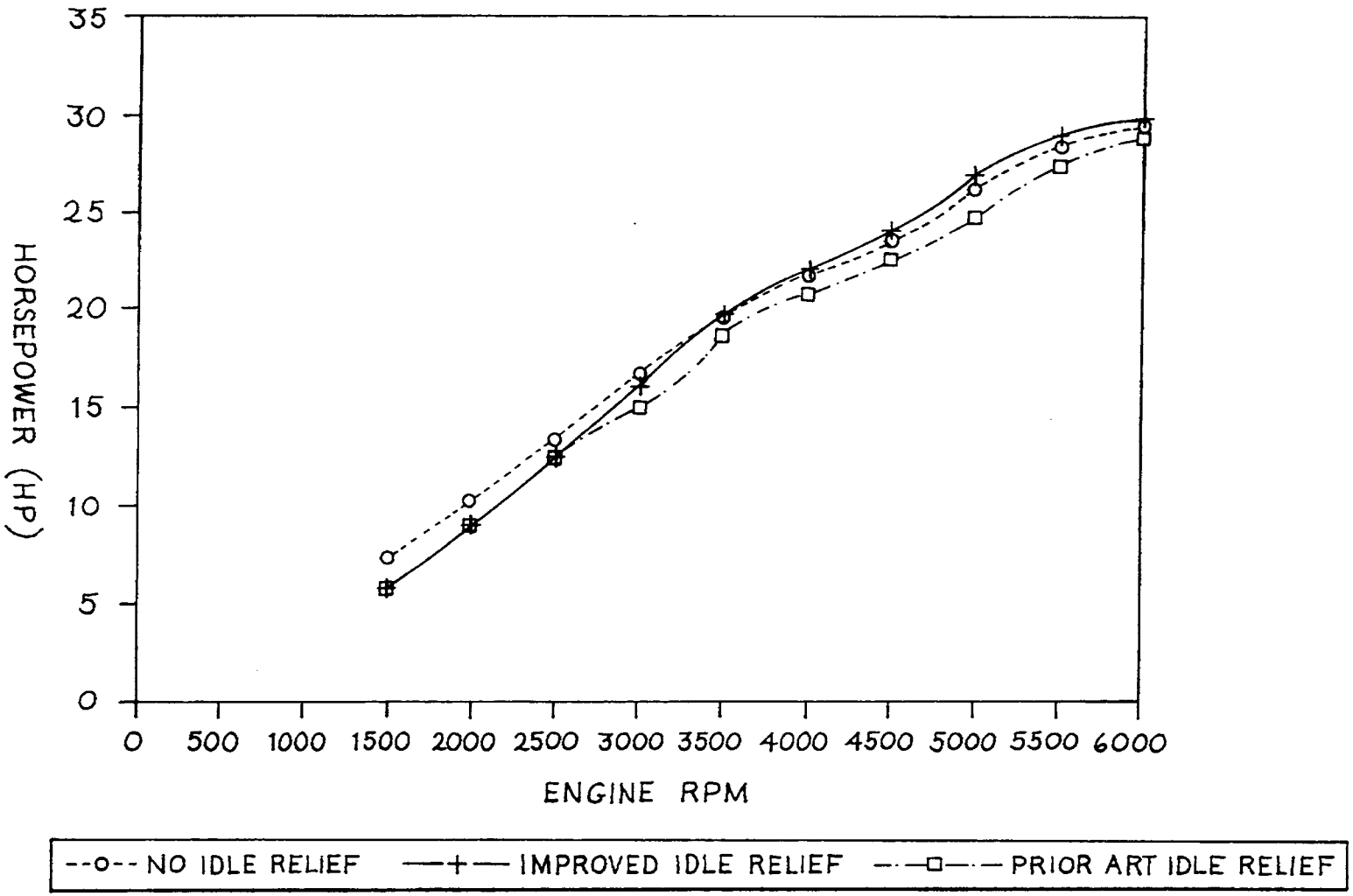
FIG. 9 is a graph of horsepower and engine speed which illustrates the improved horsepower output obtained with the idle relief of the present invention as compared to prior art idle relief arrangements.

The graphs of FIGS. 7–9 depict the results obtained with a two-cycle engine having idle relief and constructed in accordance with the above illustrative parameters, as contrasted against the same engine without idle relief. Referring initially to FIG. 7, the engine without idle relief required 105 lb. of force to start the engine, whereas the same engine provided with the idle relief structure of the present invention required only 66 lb. of force to start the engine. As will now be appreciated, the idle relief arrangement of the present invention results in a significant reduction in the force required to manually pull the rope to start a rope-start engine. The graph of FIG. 8 depicts the further attribute of the reduction in sound level at idle speeds realized with the idle relief structure of the present invention. With the above-referenced illustrative engine, the engine produced a sound level of 95 db. when running at idle speed when no idle relief was employed; whereas the same engine utilizing the idle relief of the present invention produced a sound level of only 90 db. when running at idle speed.

The graph of FIG. 9 illustrates the improved horsepower characteristics of the engine employing the improved idle relief structure of the present invention, as compared to the same engine constructed with the prior art idle relief arrangement discussed above, and also as compared to that same engine without any idle relief. As seen with reference to FIG. 9, the engine employing the prior art idle relief arrangement produces less horsepower throughout the operating speed range of the engine than the engine without any idle relief. More specifically, the engine employing the prior art idle relief arrangement produces approximately two horsepower less of power throughout the operating range of the engine in comparison with the power produced by the engine without any idle relief. This undesirable power loss was reduced significantly with employment of the improved idle relief arrangement of the present invention. With continued reference to FIG. 9, over the low operating speeds, up to approximately 2500 r.p.m., the horsepower produced by the engine employing the improved idle relief of the present invention approximated the horsepower output of the engine employing the prior art idle relief arrangement. However, at engine speeds of 3500 r.p.m. and above, the engine having the improved idle relief of the present invention produced a horsepower output approximating that of the engine having no idle relief, which is significantly higher than the horsepower output of the engine employing the prior art idle relief over this operating range. Over the intermediate operating range from 2500 r.p.m to 3500 r.p.m., the horsepower output of the engine employing the improved idle relief of the present invention is still greater than the horsepower output of an engine having the prior art idle relief arrangement, with the horsepower of the improved idle relief engine increasingly approximating that of the having no idle relief. Hence, it can be seen graphically in FIG. 9 the improved horsepower output produced with the engine having the improved idle relief of the present invention, particularly at engine speeds over 2500 r.p.m., as compared with the engine having the prior art idle relief arrangement. Importantly, this improved horsepower output realized with the idle relief of the present invention, as compared with prior art idle relief arrangements, is in addition to the beneficial attributes realized with the improved idle relief arrangement of the present invention of reduced rope start effort and reduced sound level at idle as discussed above and as illustrated in FIGS. 7 and 8.

That is, whereas the prior art idle relief arrangement was able to effect reduced rope start effort and reduced sound level at idle in comparison to the same engine without any idle relief, the prior art idle relief had the detrimental effect of reducing the horsepower output of the engine over the entire operating range of the engine. Advantageously, the idle relief arrangement of the present invention is able to effect approximately the same reduced rope start and reduced sound level as the engine having the prior art idle relief arrangement, but without the associated horsepower loss over the entire operating range of the engine which horsepower loss is realized with the aforementioned prior an idle relief arrangement.

As mentioned above, a fuel charge can only be discharged through an idle relief port during the time period from the onset of compression to the point at which the piston blocks off the idle relief port. Accordingly, the length of time during which the idle relief port 34 is unblocked by the piston is directly proportional to the engine speed. That is, the time interval during which the idle relief port 34 is unoccluded or unblocked decreases with increased engine speed. Hence, the effects associated with idle relief decrease with increased engine speed. That is, it takes time for the mixture being compressed in the combustion chamber to bleed through the small idle relief port, and the slower the engine speed the longer the idle relief port is unblocked to allow the mixture to escape the combustion chamber through the idle relief port. As the engine speed increases, the idle relief port is open during each cycle for a shorter duration, thereby reducing the amount of the mixture escaping the combustion chamber through the idle relief port, and thereby reducing the sound level and rope force attributes associated with idle relief at low speeds.

Figure 10:
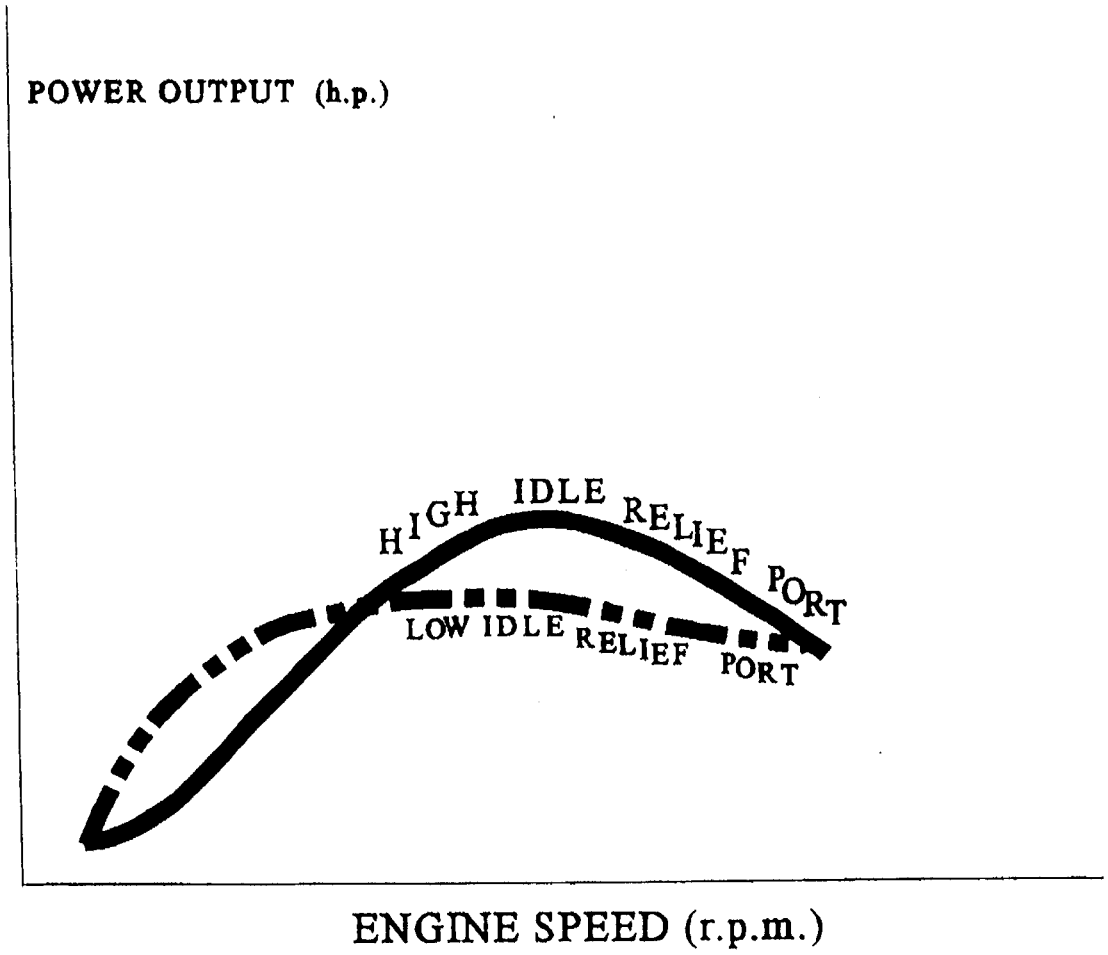
FIG. 10 is a graphical representation of the general relationship between idle relief port height and horsepower output across the operating range of an engine constructed in accordance with the principles of the present invention.
Figure 11:
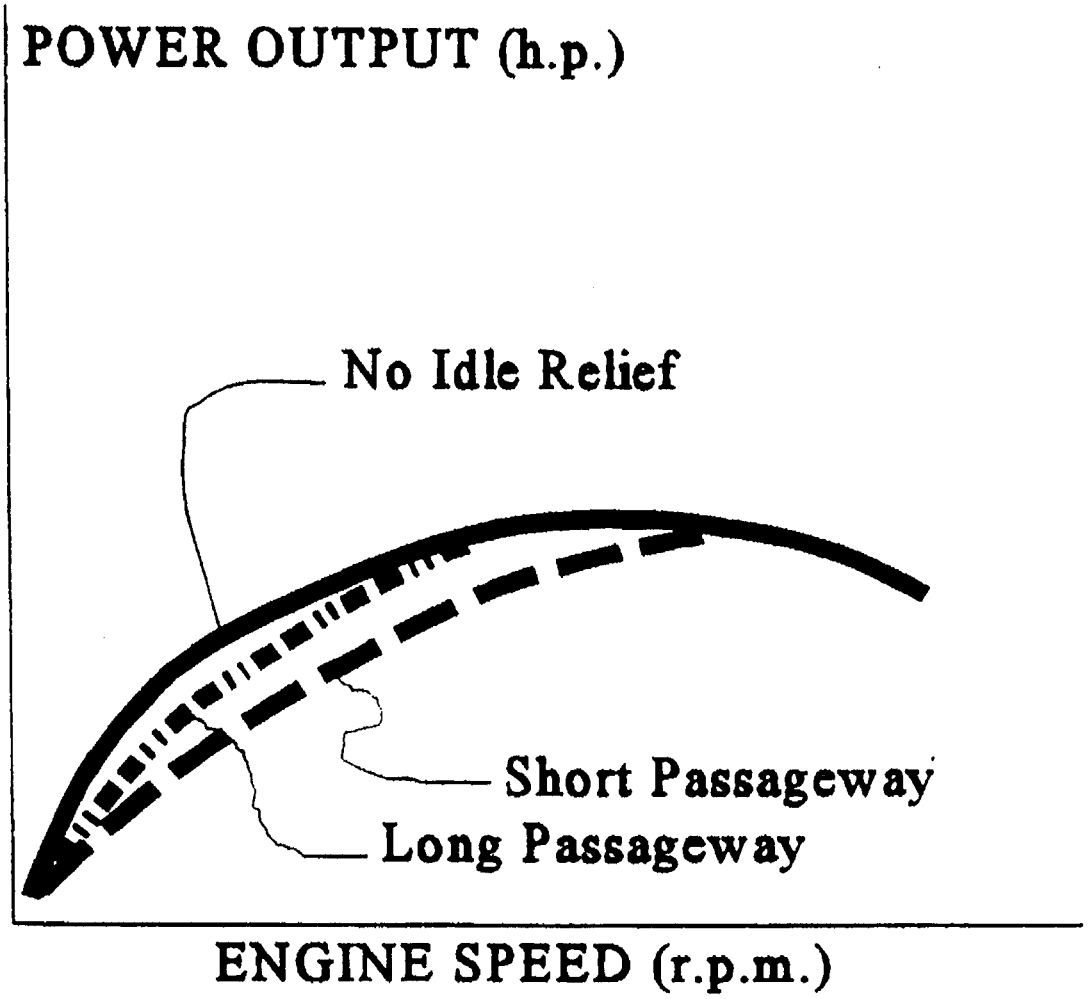
FIG. 11 is a graphical representation of the relationship between the length of the idle relief passageway and its effect on the power output of the engine across the operating range of the engine.

It was found that the height of the idle relief port 34, i.e. the distance from the idle relief port 34 to the cylinder head 56, has a significant effect on the horsepower output of the engine 30 at various operating speeds. The general relationship between the location of the idle relief port relative to its cylinder head and the corresponding effect on horsepower output is illustrated graphically in FIG. 10. Over lower engine speeds, greater horsepower output is realized with a "lower" idle relief port, i.e. an idle relief port which is further from the cylinder head 56; however, over higher engine speeds, greater horsepower output is realized with a "higher" idle relief port, i.e. an idle relief port which is closer to the cylinder head 56. Accordingly, depending upon the anticipated operating speed of an engine, one can design the engine such that its idle relief port is located at a height which will produce maximum horsepower output at the anticipated operating speed, or at some other desired speed.

Additionally, it was found that increasing the length of the idle relief passageway 32, and/or increasing the cross-sectional area of the idle relief passageway 32 such as by providing a larger diameter passageway, improved the power curve of the engine. It is believed that this is attributable to the fact that with the pistons reciprocating out of phase with one another, while a first piston **38*a* is moving upwardly in its cylinder 36*a* and compressing its fresh fuel charge in its combustion chamber 46*a*, and thereby forcing a portion of the fresh fuel charge out through its idle relief port 34*a*, the piston 38*b* in the second cylinder 36*b* is moved downwardly to a position exposing its exhaust port 52*b*. Hence, with a very short idle relief passageway 32, virtually all of the fresh fuel discharged from the first cylinder 36*a* will be forced into the second cylinder 36*b* while its exhaust port 52*b* is open, thereby allowing the discharge of a significant amount of fresh fuel through its exhaust port 52*b* prior to its combustion. With a longer and/or wider idle relief passageway interconnecting the idle relief ports 34*a* and 34*b*, when fresh fuel is displaced from a first cylinder 36*a* through its idle relief port 34*a*, a greater amount of the fuel charge fuel is retained within the idle relief passageway 32 so that it is not discharged into the second cylinder 36*b* where it would merely be discharged uncombusted through the second cylinder's exhaust port 52*b***.

As will be readily apparent to those skilled in the art, each cylinder 36 of an engine 30 may have its exhaust port 52, transfer port 48, and idle relief port 34 at a different position or height relative to the positions or heights of the exhaust, transfer and/or idle relief ports in other cylinders of the engine.

The graphs of FIGS. 7–9 depict the results obtained with an engine constructed in accordance with the above illustrative parameters and having idle relief, as contrasted against the same engine without idle relief. Referring initially to FIG. 7, the engine without idle relief required 105 lb. of pulling force on the rope to start the engine, whereas the same engine provided with the idle relief structure of the present invention required only 66 lb. of pulling force on the rope to start the engine. As will now be appreciated, the idle relief arrangement of the present invention results in a significant reduction in the force required to manually pull the rope to start a rope-start engine. The graph of FIG. 8 depicts the further attribute of the reduction in sound level at idle speeds realized with the idle relief structure of the present invention. With the above-referenced illustrative engine, the engine produced a sound level of 95 db. when running at idle speed when no idle relief was employed; whereas the same engine utilizing the idle relief of the present invention produced a sound level of only 90 db. when running at idle speed.

The graph of FIG. 9 illustrates the improved horsepower characteristics of the engine employing the improved idle relief structure of the present invention, as compared to the same engine constructed with the prior art idle relief arrangement discussed above, and also as compared to that same engine without any idle relief. As seen with reference to FIG. 9, the engine employing the prior art idle relief arrangement produces less horsepower throughout the operating speed range of the engine than the engine without any idle relief. More specifically, the engine employing the prior art idle relief arrangement produces approximately two horsepower less of power throughout the operating range of the engine in comparison with the power produced by the engine without any idle relief. This undesirable power loss was reduced significantly with employment of the improved idle relief arrangement of the present invention. With continued reference to FIG. 9, over the low operating speeds, up to approximately 2500 r.p.m., the horsepower produced by the engine employing the improved idle relief of the present invention approximated the horsepower output of the engine employing the prior art idle relief arrangement. However, at engine speeds of 3500 r.p.m. and above, the engine having the improved idle relief of the present invention produced a horsepower output approximating that of the engine having no idle relief, which is significantly higher than the horsepower output of the engine employing the prior art idle relief over this operating range. Over the intermediate operating range from 2500 r.p.m. to 3500 r.p.m., the horspower output of the engine employing the improved idle relief of the present invention is still greater than the horsepower output of an engine having the prior art idle relief arrangement, with the horsepower of the improved idle relief engine increasingly approximating that of the having no idle relief. Hence, it can be seen graphically in FIG. 9 the improved horsepower output produced with the engine having the improved idle relief of the present invention, particularly at engine speeds over 2500 r.p.m., as compared with the engine having the prior art idle relief arrangement. Importantly, this improved horsepower output realized with the idle relief of the present invention, as compared with prior art idle relief arrangements, is in addition to the beneficial attributes realized with the improved idle relief arrangement of the present invention of reduced rope start effort and reduced sound level at idle as discussed above and as illustrated in FIGS. 7 and 8.

That is, whereas the prior art idle relief arrangement was able to effect reduced rope start effort and reduced sound level at idle in comparison to the same engine without any idle relief, the prior art idle relief had the detrimental effect of reducing the horsepower output of the engine over the entire operating range of the engine. Advantageously, the idle relief arrangement of the present invention is able to effect approximately the same reduced rope start and reduced sound level as the engine having the prior art idle relief arrangement, but without the associated horsepower loss over the entire operating range of the engine which is realized with the prior art idle relief arrangement.

Figure 5:
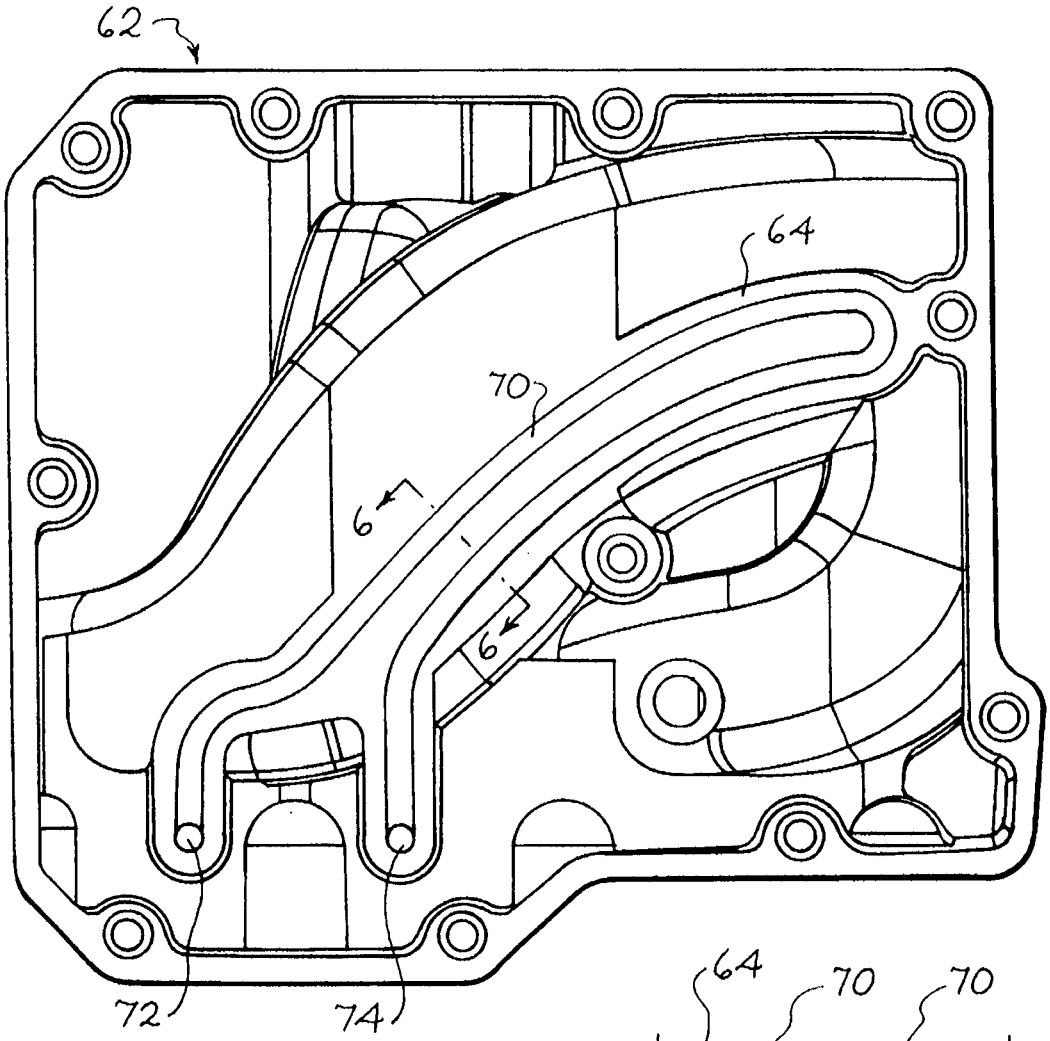
FIG. 5 is a front elevational view of an engine cover embodying various features of the present invention.
Figure 6:
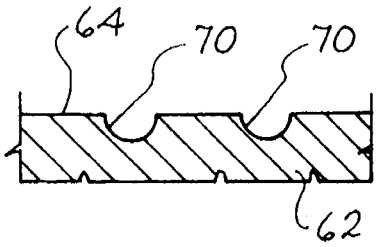
FIG. 6 is an enlarged, partial sectional view of the passageway-defining portion of the engine cover taken along line 6–6 of FIG. 5.
Figure 4:
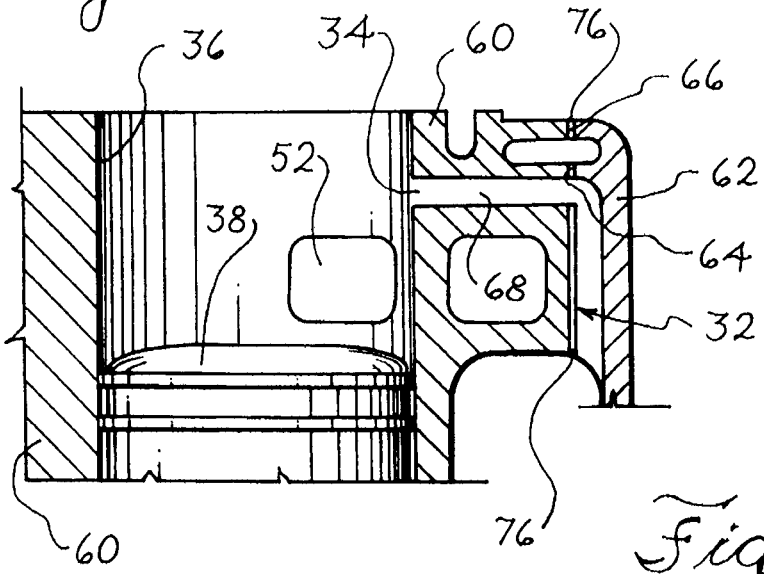
FIG. 4 is a partial, sectional view of a portion of an engine embodying various features of the present invention, illustrating the use of an engine cover to provide and define the passageways between two or more cylinders.

The idle relief passageway 32 may be provided in a number of ways. In light of the difficulty in manufacture associated with forming internal passageways in engine blocks, which are typically formed by die-casting, one particularly advantageous means for providing the idle relief passageway 32 extending between the idle relief ports 34 of two cylinders 36 is through utilization of an engine cover such as the engine cover 62 illustrated in FIGS. 4–6. The engine cover 62 has a front engaging surface 64 which engages flush against a complementary engaging surface 66 of the engine block 60. The engine block has holes 68 drilled in it extending from the front engaging surface 66 of the engine block 60 into the respective idle relief ports 34 of the cylinders 36. The engine cover 62 has a groove or channel 70 formed in its front engaging surface 64, such as by end milling or the like. The first end 72 and second end 74 of the channel 70 are formed at a location or position such that they register with respective exhaust ports 52 of two cylinders when the engine cover 62 is engaged in proper registration with the engine block 60. Upon engagement of the engine cover 62 with the front engaging surface 66 of the engine block 60, the area contiguous with the channel 70 forms a sealing engagement with the front engaging surface of the engine block surrounding the channel 70, with the channel 70 defining a space or passageway between the front engaging surface 66 of the engine block 60 and the engine cover 62. Therefore, fluids passing out of the first cylinder **36*a* of an engine 30 through its idle relief port 34*a*, pass through the channel 70 and are confined within the channel as the fluids are directed into the idle relief port 34*b* of the second cylinder 36*b*. A gasket 76 may be employed between the engaging surface 64 of the engine cover 62 and the engaging surface 66 of the engine block 60 to assure a more reliable sealing therebetween to prevent the escape to atmosphere of the fluids passed through the idle relief passageway 32. As will now be appreciated, the utilization of the engine cover 62 to define the idle relief passageway 32 allows for very accurate control of the shape and length of the idle relief passageway. A particular advantage of this structure is that it allows the formation of idle relief passageways which are longer and/or wider than the idle relief passageways attainable interiorly of the many engine blocks. For engines having more than two cylinders, a single engine cover having a plurality of separate channels formed therein for interconnecting respective exhaust ports may be employed, or alternatively a plurality of separate engine covers 62 may be employed, or any combination of the above. It is desirable that the idle relief passageway 32 be constructed such that the volume of the idle relief passageway 32** is proportional to the volume displaced by the piston upon movement of the upper end of the piston from a position at which it first blocks the exhaust port to a position at which it first blocks the idle relief port.

While the present invention is described herein by way of illustrative and preferred embodiments, the present invention is not limited to the specific embodiments set forth herein, and it will be readily apparent to those skilled in the art that numerous modifications and variations can be made thereto without departing from the essence and scope of the invention as forth in the accompanying claims.

What is claimed is:

1. A two-cycle internal combustion engine, comprising:

an engine block including at least two cylindrical walls defining at least two cylinders having respective head ends;

at least two pistons, each reciprocal within a respective one of said cylinders, and with said at least two pistons reciprocating out of phase with one another;

said at least two cylinders each having a respective transfer port and a respective exhaust port;

said at least two cylinders each having an idle relief port disposed between its respective exhaust port and head end; and a passageway between the idle relief ports of said at least two cylinders for providing communication between the idle relief ports of said at least two cylinders.

2. An engine in accordance with claim 1 in which said at least two pistons comprises two pistons which reciprocate approximately 180 degrees out of phase with respect to one another.

3. An engine in accordance with claim 1 in which said idle relief passageway is defined at least in part by said engine block.

4. An engine in accordance with claim 1 in which said idle relief passageway is defined at least in part by an engine cover engageable with said engine block.

5. An engine in accordance with claim 4 in which said engine cover has an engine block engaging surface with a channel formed in said engine block engaging surface, whereby upon engagement of the engine cover with the engine block the region between said engine block and said engine cover defines at least a part of said idle relief passageway.

6. An engine in accordance with claim 1 in which the volume of the idle relief passageway is proportional to the volume displaced by the piston upon movement of the upper end of the piston from a position at which it first blocks the exhaust port to a position at which it first blocks the idle relief port.

7. An engine in accordance with claim 1 in which said idle relief passageway extends uninterrupted between the idle relief ports.

8. An engine in accordance with claim 1 in which the idle relief ports are disposed at approximately 57 degrees after top dead center.

9. An engine in accordance with claim 1 in which the idle relief ports are approximately 0.25 inch in diameter.

10. A two-cycle internal combustion engine comprising:

an engine block including cylindrical walls defining at least two cylinders having respective head ends;

pistons mounted for reciprocative movement in respective ones of said at least two cylinders relative to their respective cylinder head ends, with the pistons being reciprocally movable in their respective cylinders out of phase with one another;

said cylindrical walls of said at least two cylinders each having a respective exhaust port having upper and lower edges at given, respective distances from their respective cylinder head ends;

said cylindrical walls of said at least two cylinders each having a respective idle relief port having upper and lower edges, the upper edges of the idle relief ports being disposed a shorter distance from the respective cylinder head ends than the upper edges of the respective exhaust ports; and a passageway for providing communication between the exhaust ports of the respective cylinders.

11. A two-cycle engine in accordance with claim 10 in which the lower edge of the idle relief ports are disposed a shorter distance from their respective cylinder head ends than the upper edges of the exhaust ports.

12. A two-cycle engine in accordance with claim 10 in which the length of the passageway is significantly greater than the distance between the two cylinders.

13. A two-cycle engine in accordance with claim 10 in which the length of the passageway is at least five times greater than the distance between the two cylinders.

14. A two-cycle engine in accordance with claim 10 in which the passageway is defined at least in part by an engine cover engageable with said engine.

* * * * *